US009302894B2

(12) United States Patent
Poeschl et al.

(10) Patent No.: US 9,302,894 B2
(45) Date of Patent: Apr. 5, 2016

(54) APPARATUS AND METHOD FOR BOTTLING MULTI-COMPONENT BEVERAGES

(75) Inventors: Stefan Poeschl, Regensburg (DE); Josef Doblinger, Reichenbach (DE)

(73) Assignee: KRONES AG, Neutraubling (DE)

( * ) Notice: Subject to any disclaimer, the term of this patent is extended or adjusted under 35 U.S.C. 154(b) by 946 days.

(21) Appl. No.: 13/184,487

(22) Filed: Jul. 15, 2011

(65) Prior Publication Data

US 2012/0060965 A1 Mar. 15, 2012

(30) Foreign Application Priority Data

Jul. 27, 2010 (DE) ..... 10 2010 032 398

(51) Int. Cl.

| | |
|---|---|
| ***B67C 3/02*** | (2006.01) |
| ***B67C 3/20*** | (2006.01) |
| ***B65B 3/28*** | (2006.01) |
| ***B67C 3/00*** | (2006.01) |

(52) U.S. Cl.

CPC ... *B67C 3/02* (2013.01); *B65B 3/28* (2013.01); *B67C 3/001* (2013.01); *B67C 3/023* (2013.01); *B67C 3/202* (2013.01); *B67C 3/208* (2013.01); *B65B 2220/14* (2013.01)

(58) Field of Classification Search

CPC ..... B67C 3/023; B67C 3/202; B67C 3/208; B65B 1/46; B65B 3/28; B65B 3/30; B65B 3/34

USPC ..... 141/9, 83, 100, 101, 103, 129, 144–145

See application file for complete search history.

(56) References Cited

U.S. PATENT DOCUMENTS

| | | | | |
|---|---|---|---|---|
| 2,327,732 | A | 8/1943 | McKinnis | |
| 4,230,195 | A * | 10/1980 | Graffin | 177/1 |
| 5,027,869 | A * | 7/1991 | Tsumura et al. | 141/104 |
| 5,083,591 | A * | 1/1992 | Edwards et al. | 141/9 |
| 6,446,680 | B1 * | 9/2002 | Soehnlen et al. | 141/9 |
| 6,729,361 | B2 * | 5/2004 | Noell | 141/9 |
| 6,772,806 | B2 * | 8/2004 | De Villele | 141/144 |
| 8,479,784 | B2 * | 7/2013 | Goldman et al. | 141/144 |
| 8,596,307 | B2 * | 12/2013 | Krulitsch et al. | 141/9 |
| 8,616,250 | B2 * | 12/2013 | Herbert | 141/83 |
| 2002/0134456 | A1 | 9/2002 | Soehnlen et al. | |
| 2003/0145901 | A1 | 8/2003 | Noell | |
| 2004/0084104 | A1 | 5/2004 | Raniwala | |

FOREIGN PATENT DOCUMENTS

| | | |
|---|---|---|
| DE | 296 12 406 U1 | 10/1996 |
| DE | 10 2008 038 638 A1 | 2/2010 |

(Continued)

OTHER PUBLICATIONS

Japanese Office Action dated Mar. 31, 2015, issued in corresponding Japanese Application No. 2011-155318.

*Primary Examiner* — Mark A Laurenzi
*Assistant Examiner* — Timothy P Kelly
(74) *Attorney, Agent, or Firm* — Novak Druce Connolly Bove + Quigg LLP

(57) ABSTRACT

A method for filling containers with multi-component flowable media may include filling a first component into the container to be filled by means of a first filling assembly, transporting the container filled with the first component of the liquid to a second filling assembly, and filling a second component of the liquid into the container to be filled with the first component by means of the second filling assembly. After filling the first component into the container, a filling quantity of the first component is determined.

16 Claims, 3 Drawing Sheets

(56) References Cited

FOREIGN PATENT DOCUMENTS

| | | | |
|---|---|---|---|
| JP | 7-96905 | A | 4/1995 |
| WO | 2005/003017 | A1 | 1/2005 |
| WO | 2008/014333 | A2 | 1/2008 |
| WO | 2009/103426 | A1 | 8/2009 |

* cited by examiner

Fig. 3b
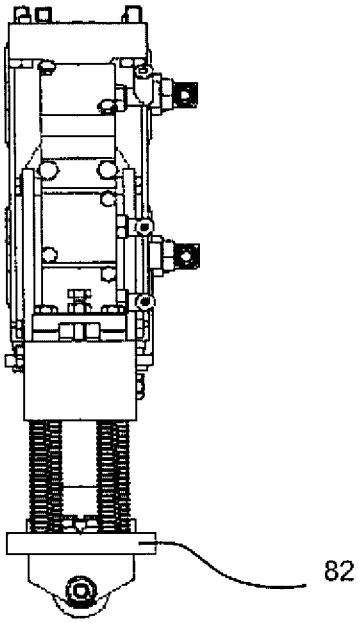
Fig. 3a
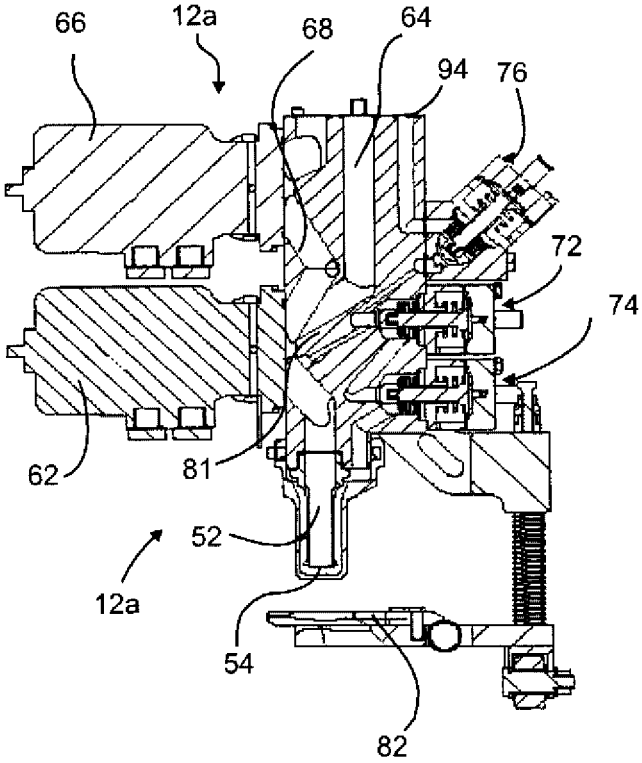
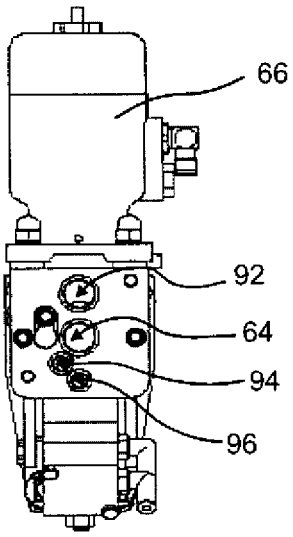
Fig. 3c

APPARATUS AND METHOD FOR BOTTLING MULTI-COMPONENT BEVERAGES

CROSS-REFERENCE TO RELATED APPLICATION

This application claims the benefit of priority of German Patent Application No. 10 2010 032 398.5, filed Jul. 27, 2010, pursuant to 35 U.S.C. 119(a)-(d), the disclosure of which is incorporated herein by reference.

TECHNICAL FIELD

The present invention relates to a method and an apparatus for filling containers.

BACKGROUND

Diverse methods and apparatus for filling containers are known from the prior art. Further, multi-component beverages are known from the prior art, i.e. beverages wherein a mix of several components is filled into the containers. As an example of this, fruit juice beverages can be mentioned wherein the beverage also contains the flesh or the pulp of the fruit. These beverages are enjoying increasing popularity.

In order to bottle such beverages it is known to mix two components with each other, for example fruit juice and pulp, prior to filling them into the container, and subsequently to supply them to the container as a mix. It is further known that during the filling process, a juice component and the flesh of the fruit are supplied to the container at the same time. Further, pre-dosing systems such as piston filling systems are known from the prior art. However, these systems are relatively difficult to clean and have the additional disadvantage that they are relatively inaccurate and can sometimes cause the destruction of the fruit pieces to be bottled. A further disadvantage of these systems is that upon dosing using a piston filler, no further data is available in relation to the exact composition of the product filled into the containers. This means that here the standard deviations of the respective components add up, so that the accuracy of the quantity filled in is reduced.

WO 2008/014333 A2 describes an apparatus and a method for bottling beverages. Here, a first part of the beverage is first filled in using first filling means and subsequently a second part of the beverage is filled in using further filling means. However, this device does not allow an exact dosing of the individual product proportions.

U.S. Pat. No. 6,729,361 B2 describes a method for filling a product with mixable components into a container. In doing so, a first product proportion is filled in on a filling carousel and a second product proportion is filled in using a second filling carousel. Apart from that, a control unit is provided which controls the quantities of the components that are filled in at each filling station of the container. No checking of said quantities is provided in this apparatus, so that considerable inaccuracies have to be expected here as well.

It may therefore be desirable to provide an apparatus and a method which allow a more accurate bottling or control of the bottled quantities in the case of multi-component beverages.

SUMMARY

In an apparatus according to the disclosure for filling containers with multi-component flowable media, a first component is filled into the container to be filled by means of first filling means in a first method step. Subsequently, the container filled with the first component of the liquid is transferred to second filling means and a second component of the medium to be bottled is filled into the container filled with the first component by means of second filling means in a further step.

According to the disclosure, a filling quantity of the medium to be filled in and in particular of the first component is determined after the first component has been filled into the container.

The flowable medium is in particular a liquid, for example, a juice or the like, or in general a liquid containing particles such as for example pieces of fruit. In some aspects, the components are mixable. In particular, the term flowable media is also to be understood to mean such media which contain particles such as for example the flesh of fruits.

According to the disclosure it is therefore proposed that once the container has been filled with the first component, the filling quantity of the first component is determined, and this measurement enables in particular also an accurate determination of the products to be bottled to be carried out. It is possible that only one single quantity determination is carried out during the entire filling process.

However, it is also possible that initially a quantitative determination of the first component and subsequently a quantitative determination of the overall quantity (from which the quantity of the first component may optionally be derived) is carried out.

In some aspects, a measurement of the filling quantity is to be carried out by way of a weight measurement. It has been shown that in particular a measurement via weight allows a very precise statement about the respective filling quantity to be made, all the more so since, if the first component is a component with the flesh or pulp of the fruit, a flow measurement for determining the volume is relatively complex. However, also a measurement using a volumetric (flow) measurement device is possible.

The process of filling in the first component, which is, for example, a component that includes particles, may be carried out in a time controlled or a time and pressure controlled manner.

However, it would also be possible for the weight measurement to be carried out between the two filling means. In this way, the second component can also be quantitatively determined using other systems, i.e. for instance volumetrically or by means of electric probes or probe tubes.

Thus it is proposed that further filling means in particular with a plurality of filling units for the first component are provided upstream of filling means for the second component. In one method, the final filling quantity (of the first component) is determined by means of a load cell as measuring means, i.e. the weight measurement is carried out once the filling in of the first component is completed. However, it would also be possible to determine the entire quantity of the product filled in.

In some aspects, the measurement of the filling quantity is carried out prior to filling in the second component. For example, the first filling means fill the container with the first component via a time control unit, but it is also possible to provide dosing pumps or means typical for pre-dosing, such as piston fillers. In the second filling means, as mentioned above, the quantity of the first component may be determined prior to filling in the second component, for example, by weighing.

Thus, the (weight) measurement of the first component filled in may be carried out at a separate location from the first filling means. In some aspects, this weight measurement is carried out in the second filling means, as a result of which the quantity of the first component as well as the overall quantity can then be determined using one and the same measuring means. It would thus be possible for said weight measuring means to determine initially the quantity (or the weight) of the first component and, in the further course and in particular after the second component has been filled in, to determine the overall quantity or the overall weight of both components. This means that according to the disclosure, one and the same measuring means can be used to carry out first a static weight measurement and then a continuous weight measurement.

A quantity measurement or weight determination between the two filling processes may have several advantages.

To start with, the required filling quantity of the second component can be calculated for each individual container, so that each container contains the same overall quantity (by mass or volume). By way of a retrospective determination of the quantity of first component that has actually been filled in, the standard deviation of the first filling is cancelled out. This in turn means that it is possible to fill in container-specific quantities of the second component on each filling valve. On the other hand, it is customary in the prior art that all filling units dose the same quantity.

Further, the time-related filling in of the first component can be continuously optimised in a manner that is specific to each filling location. If the containers filled with an initial quantity at a single filling location deviate from the target filling level (which, of course, will then be detected by said retrospective measurement), the filling time may be adapted by means of a control unit, until the target quantity of first component is filled into the bottles. This adaptation would also be possible if the first component was to be volumetrically filled. In this case, the filling of the container with a first component will therefore be controlled.

Finally, the exactly dosed quantity of fruit constituents as well as the overall filling quantity can be recorded and evaluated for each filled container by means of a suitable process control and/or documentation system. It is then a very simple operation to calculate from this the percentage of fruit constituents and to associate it with the containers. If now a system operator guarantees a certain minimum content of fruit constituents on the bottle label, (s)he would then be able to automatically remove those containers that do not reach this guaranteed quantity by tracking the filled containers.

For example, the filling quantity of first component is determined after transporting the container using the first filling means. Thus, it is possible that the filling quantity is not determined until during the transport of the container with the second filling unit, however, it would also be possible for the filling quantity to be determined during the transport of the containers from the first filling means to the second filling means.

For example, after filling in the first component, the container is still being transported by the first filling means. Thus, it is possible that the actual filling process is already completed and that after filling in the first component, the product is still being transported by the first filling means such as for example a transport carousel. Thus, it is for example possible that after the actual filling process, residual liquid still drips off from the respective filling units or filling valves or liquid is blown off, in order to enhance in this way the cleanliness of the respective filling valves.

In some aspects, the first filling means include a plurality of first filling units which are arranged for example on transport means such as a filling wheel. The individual weight measurements of the containers respectively filled with the first components allow the filling quantities of each individual filling unit on the first filling means to be individually checked and also controlled. Thus, it is possible to determine—and/or control—via a shift register of the electronics and also via the mechanically fixed design exactly how much each filling unit of the first filling means has filled in. This filling means can be controlled for example via an adaptation of the respective dosage time of the respective dosing unit of the respective filling units. For example, also the second filling means includes a plurality of second filling units for filling the containers with the second component. Here, during working operation, each second filling unit has associated therewith a first filling unit in such a way that during the filling of a certain container by means of the second filling unit it is determined which first filling unit has filled the same container with the first component.

In an exemplary method, the first component contains solids. Here, the first component may be a medium that contains pulp, fruit pieces or the like. In some aspects, the liquid is a beverage.

In an exemplary method, the filling of the container with the first component and/or the filling of the containers with the second component is controlled on the basis of the measured filling quantity (in particular of the first component). It is thus possible, as mentioned above, to adapt on the one hand the filling quantity of the first filling units, but on the other hand it would also be possible to control the respective filling quantity of the second component, for example of a fruit juice. Further, it would also be possible to store the respectively measured quantities in order to monitor in this way, also over longer periods of time, the individual filling units of the first filling means. In some aspects, an area is provided between the filling of the container with the first component and the filling of the container with the second component, in which the containers are merely transported, i.e. a rest zone is provided here.

For example, by means of measuring the first component, also the filling quantity of the second product using the second filling means can be adapted in such a way that the final filling quantity is acceptable and in this way any misfilling in respect of the dosage can be compensated, which means it is always possible that a certain substantially constant empty space remains in the container, which is of importance in particular for hot-filling processes, since the container is subject to great deformations in the case of too large an empty space. Therefore, in some aspects at least one of the two components is filled into the container at a temperature that is higher than 40°, in some aspects higher than 60°, and in some aspects higher than 70°. In some aspects, this is here the second component of the liquid. In some aspects, the filling quantities of the second filling units are controlled in such a way that the overall quantity of the product filled in is within predefined limits.

In some aspects, therefore, only one measuring means is provided for two filling functions, as a result of which only one standard deviation of a measuring unit has to be taken into account with respect to the filling quantity, and it is of course especially the final filling quantity that is of importance to the customer and the end user.

The present disclosure is further directed to an apparatus for filling containers with a multi-component flowable medium and in particular with a liquid. This device has first filling means that fill the containers with a first component of the medium, with the first filling means including at least one filling element. Further, the apparatus has second filling means that fill the containers with a second component of the medium.

Here, the second filling means include at least one filling unit and the second filling means are installed downstream of the first filling means in the transport direction of the containers. Further, transport means are provided which transport the containers from the first filling means to the second filling means. Apart from that, also volume measuring means are provided which determine a quantity of the first component to be filled into the containers.

According to the disclosure, the quantity measuring means are arranged in such a way that the quantity measurement of the medium filled into the containers, in particular the first component thereof, is carried out after the filling of the containers with the first component. It is therefore also proposed with respect to the apparatus that the quantity measurement of the first component is carried out after the latter has been filled in. It would be possible here for the entire quantity to be filled in, but advantageously the quantity may be determined after the filling in of the first component and prior to the filling in of the second component.

The transport means which transport the containers from the first filling means to the second filling means may, for example, be a star conveyor or also a transport chain. However, it would also be possible for the second filling means to follow immediately after the first filling means and for example a direct transfer from a first filling wheel to a second filling wheel to be carried out. In this case, the transport means are for example a transport element which hands the containers over from the first filling means to the second filling means, but they may also be respectively corresponding gripper elements for the containers, which are arranged on the first and the second filling wheels.

In some aspects, the first filling means include transport means which transport a plurality of filling units or on which a plurality of first filling units are arranged, and/or the second filling means also have transport means which transport a plurality of filling units.

In some aspects, the quantity measuring means are weight measuring means.

Here, the quantity measuring means may be arranged on the second filling means or on the transport means, so that a quantitative determination of the first component is carried out here even before the second component is filled in.

It would also be possible here to provide a weighing star which is located between the first filling means and the second filling means. In the case of existing systems, such a weighing star or such measuring means could also be retrofitted (separately). One advantage may be that fewer measuring points would be required, or retrofitting could be carried out if the second filling means does not have its own measuring means or any load cells.

In some aspects, a control unit is provided which doses the supply of the first component into the containers and this may in some aspects be a time controlled supply means which meters in the desired quantity as a function of time. The containers can here be checked using said load cell star and if necessary the dosed quantity can be adjusted. The weighted value can then be transferred to the second filling means for the second component and can, for example, be subtracted from the final filling quantity, in order to achieve again a constant filling level in each container after the filling in of the second component.

In some aspects, the apparatus has at least one filling unit for filling containers with a flowable product, and this filling unit has a filling pipe, through which the product is filled into the containers. This filling pipe has here an outlet section at its end, through which the product exits the filling pipe, as well as first valve means which control the supply of the flowable product into the filling pipe.

According to the disclosure, the filling means have second valve means in order to supply a gaseous medium to the filling means, in particular after a filling process, in order to remove any residues of the flowable product to be bottled.

It is to be noted that the described filling means can also be used independently from the above-mentioned apparatus. The applicant reserves the right to claim specially also the filling means. In some aspects, the filling unit is mounted on a movable and in particular rotatable carrier. In some aspects, the filling unit has a holding device for holding the containers.

In some aspects, the filling means include third valve means in order to supply a gaseous medium to the filling means. Here, control means may be provided, which supply the gaseous medium to the filling unit and in particular to the filling pipe, once the flowable product has been transported through the filling means.

Advantages and expediencies can be seen from the following description in connection with the drawings.

BRIEF DESCRIPTION OF THE DRAWINGS

In the drawings:

FIGS. 3*a*-3*c* show three views of a pre-dosing valve.

DETAILED DESCRIPTION

Figure 1:
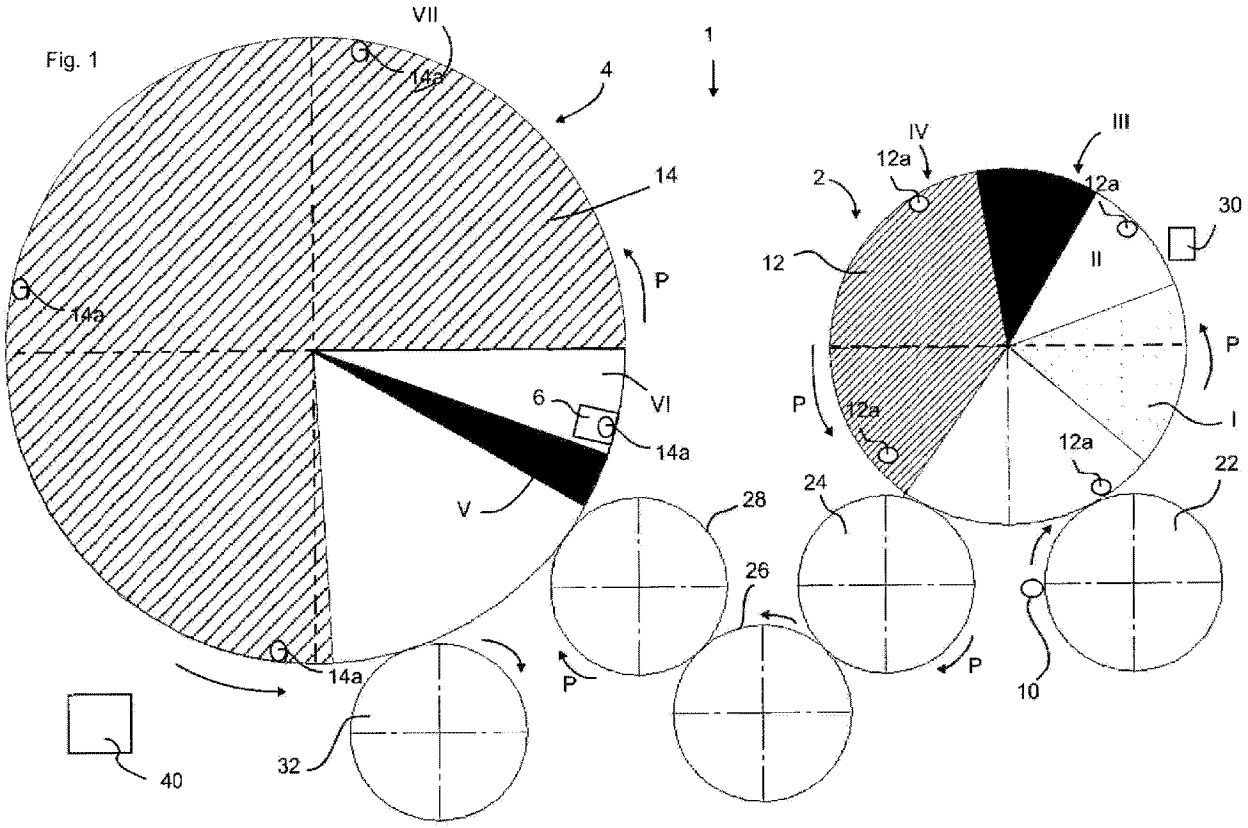
FIG. 1 shows a schematic view for illustrating a first exemplary method according to the disclosure.

FIG. 1 shows a schematic view of a method according to the disclosure. Here, containers 10 are transported along the arrows P through a filling apparatus which is identified in its entirety with 1. To start with, the containers reach, transported by a supply wheel 22, first filling means designated in their entirety with 2. In this filling means, a first component of a liquid, in particular of a beverage, is initially supplied to the containers in a section or phase I. After this dosing in of the first component, the containers are transported through a rest section II, in which no supply takes place. In a section III, the respective outlets of the filling units are blown out, in order to carry in this way any residues of the first component into the container or to remove any residues from the respective filling pipes. In a further section IV, any residues of the first component can still drip into the containers.

The first filling means include here transport means 12 such as for example a filling wheel, on which a plurality of filling units 12 is—for example, equidistantly—arranged. These individual filling units 12*a* thus fill the first component of the medium into the containers.

After this process, the containers are transported to the second filling means 4 via three star conveyors 24, 26, 28. During this transport, a settling phase V may be provided, along which no filling of the containers 10 is carried out yet. In a measuring phase VI, the quantity of the first component in the containers is measured (by measuring means 6), and in the course of this, in particular the containers with their content are weighed, which means that a static weight measurement can be carried out. To this end, quantity measuring means are provided here. It is possible here that each individual filling station or filling unit of the second filling means 4 has its own load cell 6 for measuring quantities.

Reference numeral 14 relates to transport means which transport the individual filling units 14*a* (only one filling unit 14*a* is shown). These transport means 14 are here also formed as a filling wheel on which the individual filling units may be equidistantly arranged.

In a further phase VII, the containers are filled with the second component and are subsequently carried off into a star conveyor 32. The second filling means include here a control unit 40 and the first filling means 2 also include a control unit 30. These two control units 30 and 40 are used for controlling the individual filling units which are arranged on the two filling means 2 and 4.

Here, these control units 30, 40 allow an individual control of the liquid dispensed by each individual filling unit 12*a*, 14*a*. This means that during the dispensing process of the second component a continuous weight measurement can be carried out, until the desired total weight has been filled in. If the quantity measuring means 6 determine a specified filling weight on the second filling unit 14*a*, the control unit can conclude that the corresponding container has been filled at the first filling means 2 by the corresponding first filling element 12*a*. As a response to the measured quantity, the corresponding first filling element 12*a* can be readjusted so that it will fill, for example in the next run, a higher or lower quantity of the first component into the container. It is also possible to control, by open-loop or closed-loop control, the corresponding second filling element 14*a* as a response to the weight measurement, so that it fills a higher or lower quantity of the second component into the container.

Figure 2:
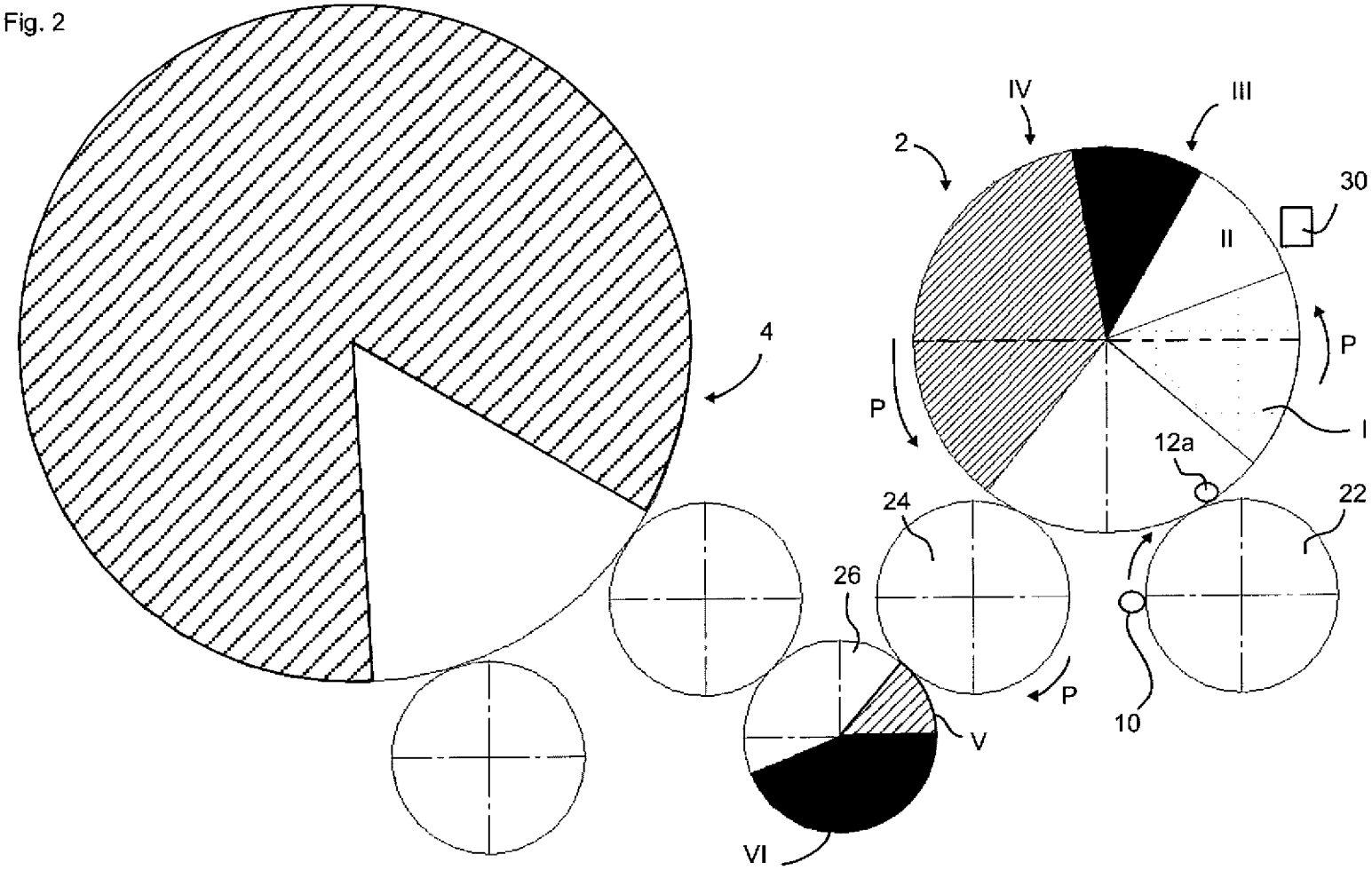
FIG. 2 shows a view for illustrating an exemplary method.

FIG. 2 shows a further embodiment of a method according to the disclosure. The filling process with the first filling means 2 corresponds here to the filling process shown in FIG. 1. Here, too, the containers are carried off by a star conveyor 24. However, the settling phase V and the measuring phase VI are here on a further carry-off wheel 26. Here, too, it is possible to determine the first filling valve 12*a* individually and, if needed, to readjust it. The second filling means 4 merely fill the containers here with the second component. The embodiment shown in FIG. 2 may be of particular advantage if a weighing star 26 is to be retrofitted on an existing system.

FIGS. 3*a*-3*c* show three views of a first filling unit 12*a* that acts here as a pre-dosing valve. This pre-dosing valve 12*a* has here a plurality of valve means. A supply line 64 carries the component to be filled in, such as for example a pulp, in the direction of a first valve 62. This first valve 62 thus controls the supply of the first component through a filling pipe 52 and an outlet section 54 into the containers (not shown), which are held here by holding devices (not shown) for example on their support ring against the outlet section 54. Reference numeral 82 identifies a covering device or CIP cap which covers the outlet section during a cleaning operation.

The filling quantity of the first component is here, for example, controlled via the time during which the valve 62 is open. This dosage time may be advantageously determined in advance by way of experiments and checked during production by the load cell 6 shown in FIGS. 1 and 2 which is, as mentioned above, located in the subsequent filling machine. The load cell 6 will then, if needed, adapt and possibly readjust the dosage time.

In order to prevent any dripping or to enhance the dosage accuracy, any product residues which upon dosing are still present in the feed pipe 52 or in the outlet section 54, may be blown out of the filling pipe 52. To this end, several blow-out pressures are used. Product residues in the blow-out nozzle 54 can occur if larger pieces of fruit get jammed in the nozzle or if after the dosage valve has been closed, the entire nozzle cross section is occupied by the product and a vacuum is formed.

It is also possible under certain circumstances that the blow-out nozzle 52, 54 empties in an uncontrolled manner because the surface tension in the case of very thin media is no longer sufficient to keep the product in the nozzle. To this end, the second valve 76 is initially opened in order to direct in this way any low pressure through the connection pipe 52 and the outlet section 54. This low pressure is used for a coarse cleaning of the blow-out nozzle. In this process, the product residues in the filling pipe 52 are slowly blown out of the blow-out nozzle 54 by a low pressure and upon the dosage process. The pressure here should not increase excessively, so that the product residues are not "shot" too quickly into the container and the already dosed product in the bottle splashes out of the bottle as a result of the impingement of the product residues. If the product residues should occur as a result of a vacuum in the blow-out nozzle 54, it is possible to open the valve 76 as early as during the dosage process (pressureless). Thus, the pipe is always vented and a coarse cleaning is not necessary. Reference numeral 94 identifies a supply line for pressurised air.

Subsequently, the second valve 76 may be advantageously closed and a third valve 72 is opened. This third valve is used for supplying high pressure into the filling pipe 52 or the outlet section 54. The high pressure is needed for blowing out the drops that are suspended on the inside wall of the filling pipe 52 or the outlet section 54. To this end, a higher flow speed of the gas in the pipe and thus also a higher pressure is used. Blowing out with a high pressure is meant to prevent any drops from falling out of the blow-out nozzle 54 in an uncontrolled manner.

In some aspects, both blow-out pressures are adjustable. It can be adjusted here when (during dosage, after dosage), how long for and at what pressure the blow-out process is carried out. As a medium for blowing out, air may be advantageously used here. However, it would also be possible, in particular in the case of sterile applications, to use sterile air for blowing out.

In some aspects, the filling pipe 52 or the outlet section 54 is coated in a suitable manner so that in this way product residues can drip off better. This coating can be applied both on the inside and on the outside.

It is thus proposed that a blowing out of the filling pipe or the outlet section 54 is carried out by means of two different pressure levels in succession. It would further also be possible for the filling operation to be carried out with an open first valve 76 and thus at a low pressure, up to an atmospheric pressure, and subsequently for a later cleaning or flushing of the filling pipe or the outlet section 54 to be carried out at a higher pressure.

Reference numeral 74 designates a further valve which is used for cleaning the filling unit 12*a*. Here, for example, a cleaning medium may be supplied and the individual pipes 52 or, if needed, also 64 can be cleaned with a cleaning medium in a special cleaning operation.

Reference numeral 66 relates to a further valve that is used for a hot return. In the case of a production stop or in preparation for production, the product may be pumped in a circuit via said valve 66, in order to keep it hot. To this end, the valve 62 is closed and the circuit runs along the supply line 64 and back via a return line 68.

The applicant reserves the right to claim all of the features disclosed in the application documents as being essential to the invention in as far as they are novel over the prior art either individually or in combination.

It will be apparent to those skilled in the art that various modifications and variations can be made to the apparatus and method for bottling multi-component beverages of the present disclosure without departing from the scope of the invention. Throughout the disclosure, use of the terms "a," "an," and "the" may include one or more of the elements to which they refer. Other embodiments of the invention will be apparent to those skilled in the art from consideration of the specification and practice of the invention disclosed herein. It is intended that the specification and examples be considered as exemplary only.

What is claimed is:

1. A method for filling containers with multi-component flowable media, the method comprising:

filling, at a first filling station, a first component of a liquid into a container by a first filling means, wherein no verification of an amount filled at the first filling station occurs at the first filling station;

transporting the container filled with the first component of the liquid from the first filling station to a second filling station;

verifying, at the second filling station, the amount filled at the first filling station; and filling, at the second filling station, a second component of the liquid into the container by a second filling means.

2. The method as claimed in claim 1, further comprising carrying out the verifying of the amount filled at the first filling station by way of a weight measurement.

3. The method as claimed in claim 1, further comprising transporting, after filling the first component into the container at the first filling station, the container by means of the first filling means.

4. The method as claimed in claim 1, wherein the first component contains solids.

5. The method as claimed in claim 1, further comprising controlling at least one of the filling of the container with the first component and the filling of the container with the second component on the basis of the amount filled at the first filling station.

6. The method as claimed in claim 1, wherein the verifying of the amount filled at the first filling station is determined after transporting the containers using the first filling means.

7. The method of claim 1, wherein, the verifying, at the second filling station, of the amount filled at the first filling station is the only amount verification which occurs at the first filling station and the second filling station.

8. The method of claim 1, wherein an initial quantitative determination of the first component is performed, and subsequently a second quantitative determination of an overall quantity is performed, at the second filling station, from which the filling quantity of the first component is derived.

9. The method of claim 1, wherein the first component is a component with a flesh or pulp of a fruit.

10. The method of claim 1, wherein a volumetric measurement device determines a filling quantity.

11. The method of claim 1, wherein the first component includes particles, and wherein filling the first component into the container is performed in one of a time-controlled manner, or a time- and pressure-controlled manner.

12. The method of claim 1, further comprising performing a weight measurement after filling the first component and prior to filling the second component.

13. The method of claim 1, wherein a filling quantity of the first component is determined prior to filling the second component.

14. The method of claim 1, wherein a filling quantity of the first component is determined at a separate location from the first filling means.

15. The method of claim 1, wherein the amount filled at the first filling station and an overall filling quantity are determined using a same measuring means.

16. The method of claim 1, wherein a same measuring means determines an initial static weight measurement, and afterwards determines a continuous weight measurement.

* * * * *